US005893663A

United States Patent [19]

Facci et al.

[11] Patent Number: 5,893,663

[45] Date of Patent: Apr. 13, 1999

[54] WEB LIQUID CHARGING: IMPROVED RESISTANCE TO CONTAMINATION

[75] Inventors: John S. Facci; Michael J. Levy, both of Webster; Christian O. Abreu, Rochester, all of N.Y.

[73] Assignee: Xerox Corporation, Stamford, Conn.

[21] Appl. No.: 08/974,097

[22] Filed: Nov. 19, 1997

[51] Int. Cl.[6] ..... G03G 15/02

[52] U.S. Cl. ..... 399/168; 361/226; 399/174

[58] Field of Search ..... 399/168, 174, 399/239, 240; 361/225, 226

[56] References Cited

U.S. PATENT DOCUMENTS

| | | | |
|---|---|---|---|
| 3,669,073 | 6/1972 | Savit et al. | 399/240 |
| 4,286,039 | 8/1981 | Landa et al. | 399/239 X |
| 4,309,803 | 1/1982 | Blaszak | 399/239 X |
| 4,493,550 | 1/1985 | Takekida | 399/240 |
| 4,587,192 | 5/1986 | Lind et al. | 399/239 X |
| 5,049,944 | 9/1991 | DeBolt et al. | 399/325 |
| 5,457,523 | 10/1995 | Facci et al. | 399/168 |
| 5,481,341 | 1/1996 | Sypula et al. | 399/239 |
| 5,493,369 | 2/1996 | Sypula et al. | 399/240 |
| 5,559,588 | 9/1996 | Larson et al. | 399/240 |
| 5,561,505 | 10/1996 | Lewis | 399/135 |
| 5,602,626 | 2/1997 | Facci et al. | 399/135 |
| 5,708,937 | 1/1998 | Lestrange et al. | 399/239 |
| 5,781,833 | 7/1998 | Lewis et al. | 399/168 |
| 5,819,141 | 10/1998 | Facci et al. | 399/174 |

*Primary Examiner*—S. Lee

[57] ABSTRACT

An electrostatographic printing machine and apparatus that utilizes a foam roll aquatron with a hydrophilic web between it and the photoreceptor. The porous web captures and removes toner particles which ordinarily would be trapped in the foam roll nip and cause image quality defects, such as streaking.

23 Claims, 2 Drawing Sheets

WEB LIQUID CHARGING: IMPROVED RESISTANCE TO CONTAMINATION

CROSS-REFERENCE

Cross-reference is made to and priority is claimed from U.S. patent application Ser. No. 08/974,098 entitled "Roll Charger with Semi-Permeable Membrane for Liquid Charging" by Facci et al.; U.S. patent application Ser. No. 08/974,099 U.S. Pat. No. 5,819,141, entitled "Control of Fluid Carrier Resistance and Water Concentration in an Aquatron Charging Device" by Facci et al.; and U.S. patent application Ser. No. 08/974,663 entitled "Method for Improving Charging Uniformity of an Aquatron" by Levy et al., each assigned to the same assignee as the present application.

BACKGROUND OF THE INVENTION

This invention relates generally to an apparatus for depositing a substantially uniform charge on an adjacent surface, and, more particularly, concerns an apparatus for enabling ion transfer via ionic conduction through an ionically conductive liquid, primarily for use in electrostatographic applications, for example, for charging an imaging member such as a photoreceptor or a dielectric charge receptor.

Generally, the process of electrostatographic reproduction is initiated by exposing a light image of an original document to substantially uniformly charged photoreceptive member. Exposing the charged photoreceptive member to a light image discharges the photoconductive surface thereof in areas corresponding to non-image areas in the original document, while maintaining the charge on image areas to create an electrostatic latent image of the original; the original is subsequently developed into a visible image by a process in which a charged developing material is deposited onto the photoconductive surface of the photoreceptor such that the developing material is attracted to the charged image areas on the photoconductive surface. Thereafter, the developing material is transferred from the photoreceptive member to a copy sheet or some other image support substrate to which the image may be permanently affixed for producing a reproduction of the original document. In a final step in the process, the photoconductive surface of the photoreceptive member is cleaned to remove any residual developing material therefrom in preparation for successive imaging cycles.

The above-described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images.

Various devices and apparatus have been proposed for use in electrostatographic applications to apply an electrostatic charge or a charge potential to a photoconductive surface prior to the formation of a light image thereon. Typically, corona generating devices are utilized, wherein a suspended electrode comprising one or more fine conductive elements is biased at a high electric potential, causing ionization of surrounding air which results in deposition of an electric charge on an adjacent surface. An example of such a corona generating device is described in U.S. Pat. No. 2,836,725 to R. G. Vyverberg, wherein a conductive corona electrode in the form of an elongated wire is partially surrounded by a conductive shield. The corona electrode is provided with a DC voltage, while the conductive shield is usually electrically grounded. A dielectric surface to be charged is spaced from the wire on the side opposite the shield and is mounted on a grounded substrate. Alternatively, the corona device may be biased in a manner taught in U.S. Pat. No. 2,879,395, wherein an AC corona generating potential is applied to the conductive wire electrode and a DC potential is applied to a conductive shield partially surrounding the electrode. This DC potential regulates the flow of ions from the electrode to the surface to be charged. Because of this DC potential, the charge rate can be adjusted, making this biasing system ideal for self regulating systems. Other biasing arrangements are known in the prior art and will not be discussed in great detail herein.

In addition to charging the imaging surface of an electrostatographic system prior to exposure, corona generating devices, so-called corotrons, can be used in the transfer of an electrostatic toner image from a photoreceptor to a transfer substrate, in tacking and detacking paper to or from the imaging member by neutralizing charge on the paper, and, generally, in conditioning the imaging surface prior to, during, and after the deposition of toner thereon to improve the quality of the xerographic output copy.

Several problems have historically been associated with corona generating devices as described hereinabove. The most notable problem centers around the inability of such corona devices to provide a uniform charge density along the entire length of the corona generating electrode, resulting in a corresponding variation in the magnitude of charge deposited on associated portions of the adjacent surface to be charged. Other problems include the use of very high voltages (6000–8000 V) requiring the use of special insulation, maintenance of corotron wires, low charging efficiency, the need for erase lamps and lamp shields and the like, arcing caused by non-uniformities between the coronode and the surface being charged, vibration and sagging of corona generating wires, contamination of corona wires, and, in general, inconsistent charging performance due to the effects of humidity and airborne chemical contaminants on corona devices. More importantly, corona devices generate ozone, resulting in well-documented health and environmental hazards. Corona charging devices also generate oxides of nitrogen which eventually desorb from the corotron and oxidize various machine components, thereby adversely effecting the quality of the final output print.

Various approaches and solutions to the problems inherent to the use of suspended wire corona generating charge devices have been proposed. For example, U.S. Pat. No. 4,057,723 to Sarid et al. shows a dielectric coated coronode uniformly supported along its length on a conductive shield or on an insulating substrate. That patent shows a corona discharge electrode including a conductive wire coated with a relatively thick dielectric material, preferably glass or an inorganic dielectric, in contact with or spaced closely to a conductive shield electrode. U.S. Pat. No. 4,353,970 discloses a bare wire coronode attached directly to the outside of a glass coated secondary electrode. U.S. Pat. No. 4,562,447 discloses an ion modulating electrode that has a plurality of apertures capable of enhancing or blocking the passage of ion flow through the apertures. In addition, alternatives to corona generating charging systems have been developed. For example, roller charging systems, as exemplified by U.S. Pat. Nos. 2,912,586 to Gundlach; 3,043,684 to Mayer; 3,398,336 to Martel et al., have been disclosed and discussed in numerous articles of technical literature.

The present invention relates to a device for charging photoconductive imaging members by ionic conduction through a fluid media, wherein corona generating devices together with their known disadvantages can be avoided. The following disclosures may be relevant to various aspects of the present invention and may be briefly summarized as follows:

U.S. Pat. No. 5,602,626 to Facci et al. discloses an apparatus for applying an electrical charge to a charge retentive surface by transporting ions through an ionically conductive liquid and transferring the ions to the member to be charged across the liquid/charge retentive surface interface. The ionically conductive liquid is contacted with the charge retentive surface for depositing ions onto the charge retentive surface via a wetted donor blade supported within a conductive housing, wherein the housing is coupled to an electrical power supply for applying an electrical potential to the ionically conductive liquid. In one specific embodiment, the charging apparatus includes a support blade for urging the donor blade into contact with the charge retentive surface and a wiping blade for wiping any liquid from the surface of the charge retentive surface as may have been transferred to the surface at the donor blade/charge retentive surface interface.

U.S. Pat. No. 5,561,505 to Lewis discloses an apparatus for applying an electrical charge to a charge retentive surface by transporting ions through an ionically conductive liquid and transferring the ions to the member to be charged across the liquid/charge retentive surface interface. The ionically conductive liquid is contacted with the charge retentive surface for depositing ions onto the charge retentive surface via a wetted donor blade supported within a mechanically sealable housing adapted to permit movement of the wetted donor blade from an operative position in contact with the charge retentive surface, to a non-operative position stored within the housing to prevent loss of the ionically conductive liquid in its liquid or vapor form so as to extend the functional life of the apparatus. In one specific embodiment, a wiper blade may be provided for removing any liquid droplets from the surface of the photoreceptor as may have been transferred at the donor blade/charge retentive surface interface.

U.S. Pat. No. 5,457,523 to Facci et al. discloses a device for applying an electrical charge to a charge retentive surface by transporting ions in a fluid media and transferring the ions to the member to be charged across the fluid media/charge retentive surface interface. The fluid media is positioned in contact with a charge retentive surface for depositing ions onto the charge retentive surface. In one specific embodiment, the fluid media is a ferrofluid material wherein a magnet is utilized to control the position of the fluid media, which, in turn, can be utilized to selectively control the activation of the charging process.

U.S. Pat. No. 5,049,944 to DeBolt et al. discloses an apparatus and method for applying offset preventing liquid to a fuser roll including an oil impregnated web member adapted to be moved by a motor from a supply core to a take up core; and a control to vary the duty cycle operation of the motor to drive the web member at a relatively constant linear speed at a contact nip, the control including a timer to monitor the cumulative time of operation of the motor to drive the web member at a relatively constant linear speed at a contact nip, the control including a timer to monitor the cumulative time of operation of the motor and to progressively decrease the duty cycle of the motor in response to the cumulative time of operation wherein the progressively decreased duty cycle of operation compensates for the increasing radius of the web member on the take up core to maintain the relatively constant linear speed at the contact nip.

SUMMARY OF INVENTION

Briefly stated, and in accordance with one aspect of the present invention, there is provided an apparatus for applying an electrical charge to an imaging surface capable of movement, comprising: an ionically conductive liquid; a contact member, wetted by the ionically conductive liquid, contacts the imaging surface to minimize contamination of the imaging surface; and a dispensing member for providing delivery of the ionically conductive liquid to the contact member.

Pursuant to another aspect of the present invention, there is provided an electrostatographic printing apparatus including a charging device for applying an electrical charge to an imaging member having movement, comprising: an ionically conductive liquid; a contact member, wetted by the ionically conductive liquid, contacts the imaging surface to minimize contamination of the imaging surface; and a dispensing member for providing delivery of the ionically conductive liquid to the contact member.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 2:
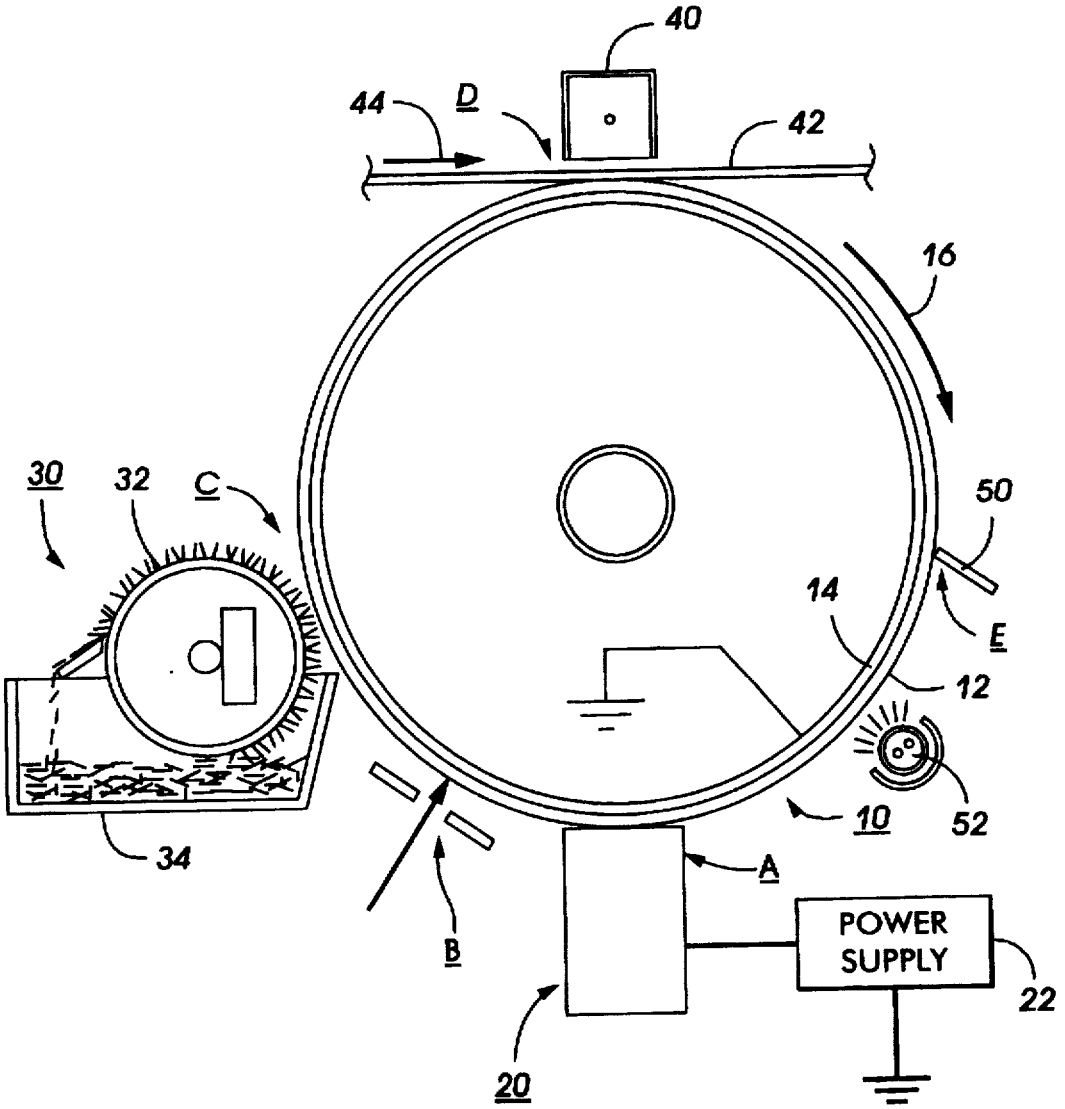
FIG. 2 is a schematic elevational view showing an electrophotographic copier employing the features of the present invention.

For a general understanding of the features of the present invention, reference is made to the drawings wherein like reference numerals have been used throughout to designate identical elements. Referring initially to FIG. 2 prior to describing the invention in detail, a schematic depiction of the various components of an exemplary electrophotographic reproducing apparatus incorporating the fluid media charging structure of the present invention is provided. Although the apparatus of the present invention is particularly well adapted for use in an automatic electrophotographic reproducing machine, it will become apparent from the following discussion that the present fluid media charging structure is equally well suited for use in a wide variety of electrostatographic processing machines and is not necessarily limited in its application to the particular embodiment or embodiments shown herein. In particular, it should be noted that the charging apparatus of the present invention, described hereinafter with reference to an exemplary charging system, may also be used in a transfer, detack, or cleaning subsystem of a typical electrostatographic apparatus since such subsystems also require the use of a charging device.

The exemplary electrophotographic reproducing apparatus of FIG. 2 employs a drum 10 including a photoconductive surface 12 deposited on an electrically grounded conductive substrate 14. A motor (not shown) engages with drum 10 for rotating the drum 10 to advance successive portions of photoconductive surface 12 in the direction of arrow 16 through various processing stations disposed about the path of movement thereof, as will be described.

Initially, a portion of drum 10 passes through charging station A.

At charging station A, a charging structure in accordance with the present invention, indicated generally by reference numeral 20, charges the photoconductive surface 12 on drum 10 to a relatively high, substantially uniform potential. This charging device will be described in detail hereinbelow.

Once charged, the photoconductive surface 12 is advanced to imaging station B where an original document (not shown) is exposed to a light source for forming a light image of the original document which is focused onto the charged portion of photoconductive surface 12 to selectively dissipate the charge thereon, thereby recording an electrostatic latent image corresponding to the original document onto drum 10. One skilled in the art will appreciate that a properly modulated scanning beam of energy (e.g., a laser beam) may be used to irradiate the charged portion of the photoconductive surface 12 for recording the latent image thereon.

After the electrostatic latent image is recorded on photoconductive surface 12, drum 10 is advanced to development station C where a magnetic brush development system, indicated generally by the reference numeral 30, deposits developing material onto the electrostatic latent image. The magnetic brush development system 30 includes a single developer roller 32 disposed in developer housing 34. Toner particles are mixed with carrier beads in the developer housing 34, creating an electrostatic charge therebetween which causes the toner particles to cling to the carrier beads and form developing material. The developer roller 32 rotates to form a magnetic brush having carrier beads and toner particles magnetically attached thereto. As the magnetic brush rotates, developing material is brought into contact with the photoconductive surface 12 such that the latent image thereon attracts the toner particles of the developing material, forming a developed toner image on photoconductive surface 12. It will be understood by those of skill in the art that numerous types of development systems could be substituted for the magnetic brush development system shown herein.

After the toner particles have been deposited onto the electrostatic latent image for development thereof, drum 10 advances the developed image to transfer station D, where a sheet of support material 42 is moved into contact with the developed toner image via a sheet feeding apparatus (not shown). The sheet of support material 42 is directed into contact with photoconductive surface 12 of drum 10 in a timed sequence so that the developed image thereon contacts the advancing sheet of support material 42 at transfer station D. A charging device 40 is provided for creating an electrostatic charge on the backside of sheet 42 to aid in inducing the transfer of toner from the developed image on photoconductive surface 12 to a support substrate 42 such as a sheet of paper. While a conventional coronode device is shown as charge generating device 40, it will be understood that the fluid media charging device of the present invention can be substituted for the corona generating device 40 for providing the electrostatic charge which induces toner transfer to the support substrate materials 42. The support material 42 is subsequently transported in the direction of arrow 44 for placement onto a conveyor (not shown) which advances the sheet to a fusing station (not shown) which permanently affixes the transferred image to the support material 42 creating a copy or print for subsequent removal of the finished copy by an operator.

Invariably, after the support material 42 is separated from the photoconductive surface 12 of drum 10, some residual developing material remains adhered to the photoconductive surface 12. Thus, a final processing station, namely cleaning station E, is provided for removing residual toner particles from photoconductive surface 12 subsequent to separation of the support material 42 from drum 10. Cleaning station F can include various mechanisms, such as a simple blade 50, as shown, or a rotatably mounted fibrous brush (not shown) for physical engagement with photoconductive surface 12 to remove toner particles therefrom. Cleaning station F may also include a discharge lamp (not shown) for flooding the photoconductive surface 12 with light in order to dissipate any residual electrostatic charge remaining thereon in preparation for a subsequent imaging cycle. As will be described, the present invention may also be utilized as a substitute for such a discharge lamp to counter any residual electrostatic charge on the photoconductive surface 12.

The foregoing description should be sufficient for purposes of the present application for patent to illustrate the general operation of an electrophotographic reproducing apparatus incorporating the features of the present invention. As described, an electrophotographic reproducing apparatus may take the form of any of several well known devices or systems. Variations of the specific electrostatographic processing subsystems or processes described herein may be expected without affecting the operation of the present invention.

An aquatron (i.e. liquid charging) is an ozone-free contact charging device that is based on electrification of a water (or other liquid) moistened pad in contact with the photoreceptor surface. Its advantage over other contact charging techniques in that it provides excellent charging uniformity over a wide range of process speeds, e.g. to 50 ips and is DC-only. It is nearly 100% efficient, operating at near theoretical voltage and current levels. It is also capable of a very small footprint.

However, in order to obtain long term image quality it is necessary to ensure both uniform delivery of water to the contact pad and to minimize contamination to this contact pad. Contamination is caused by toner that passes by the cleaning blade/brush and by paper fibers and fillers. Long term print tests with a retrofitted aquatron have been conducted at 62 cpm in a 5065 Xerox machine operating in the DAD (Discharge Area Development) mode. Significant quantities of residual toner left behind by the cleaning blade accumulated at the input of the nip 18 of the aquatron contact pad. Image quality deterioration begins from time zero prints. Prints contained dark streaks in the process direction where it is believed that the toner prevents intimate contact of the contact pad with the photoreceptor.

Figure 1:
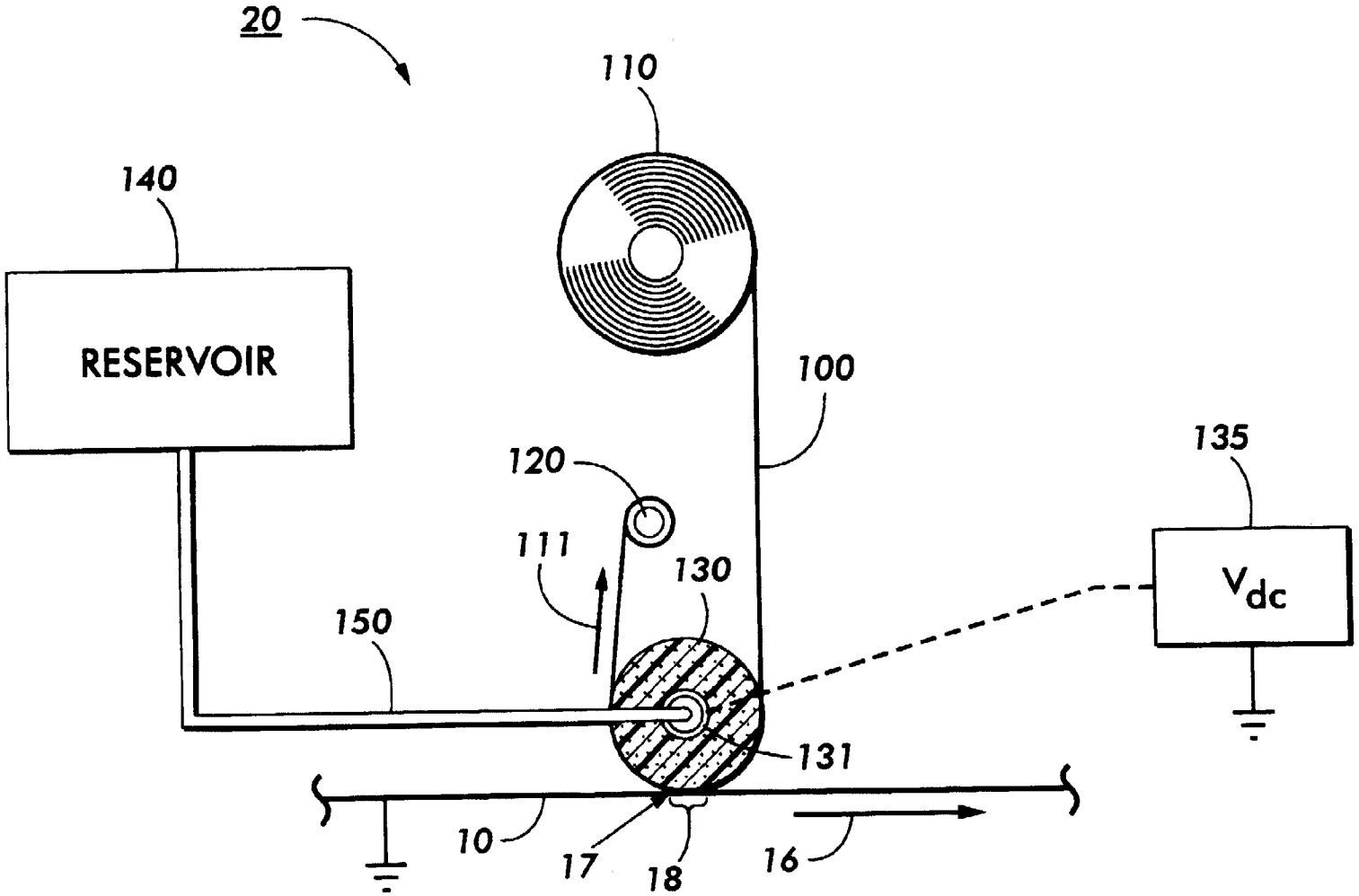
FIG. 1 is an elevational schematic of the present invention.

An elevational schematic view of the present invention is shown in FIG. 1. FIG. 1 shows a hydrophilic web 100 wound onto a supply roll 110 and a take-up roll 120. The web 100 is passed over a wetting or moistening device such as a porous tube 130. The porous tube contains a perforated shaft 131 therethrough. A DC voltage 135 is attached to the shaft to provide charge thereto. (The DC voltage can be applied to the ionically conductive liquid by a conductive brush, commutator, wire, or similar device. This voltage application contact can occur at a reservoir, delivery tubing, porous tube, central roller or the wetted section of the web.) The porous tube 130 uniformly moistens the web 100. (There are other ways of wetting or moistening the web, the porous tube is one example.) As copies are made, the web 100 which is initially wound onto the supply roller 110, is slowly advanced or indexed in a direction (shown by arrow 111) counter to the photoreceptor 10 motion (shown by arrow 16), ensuring that the contamination (e.g. residual toner particles, paper debris, talc and other such elements in the machine) at the entrance nip 17 is kept to a minimum as it is carried away by the web 100. Also, the contamination is kept out of the nip 18. The indexing/advancing motion of the web is much slower than the process speed and can be driven by gearing down from the photoreceptor drive. This indexing/advancing motion is calculated using the formula 1000/v, where v is the process speed. The preferred rate of advance ranges from about 0.1 multiplied by (1000/v) to about 10 multiplied by (1000/v). The rate of advancement is controlled by the rate at which contamination accumulates on the web 100. Experience with contamination suggests that an advancement rate of 1.0 cm kilocopy should be sufficient, assuming a contact zone of 1.0 inch. This leads to a web usage of about four (4) feet in 100,000 (one hundred thousand) copies. A further advantage of the web is that the scratching of the photoreceptor and wear can be minimized because the abrasive toner is removed from the nip 18. The cleaning action of the web 100 might actually decrease image noise as well.

The charging web 100 is contacted against the photoreceptor 10 by a contact pad 130 which supplies a charging fluid to the belt at a controlled rate. For example, the rate of moisture delivery can be actively controlled by a sensor and a pump as described in pending U.S. application Ser. No. 08/974,099, U.S. Pat. No. 5,819,141, entitled "Control of Fluid Carrier Resistance and Water Concentration in an Aquatron Charging Device". Liquid flow to the web can also be actively regulated by pumping at a predetermined rate. The fluid delivery member (or conduit) 150, from the reservoir 140, ensures an even contact pressure across the width of the photoreceptor 10. The width of the contact pad 130 determines the nip width. A web aquatron is useful for a mid-volume machine, high volume machine, and a production machine where a large amount of contamination can accumulate because of high average monthly copy volume.

In recapitulation, the present invention utilizes a foam roll aquatron with a hydrophilic web between it and the photoreceptor. The porous web captures and removes toner particles which ordinarily would be trapped in the foam roll nip and cause streaking.

It is, therefore, apparent that there has been provided in accordance with the present invention, an aquatron with a hydrophilic web that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for applying an electrical charge to a movable imaging surface defining a direction of motion comprising:

an ionically conductive liquid;

a contact member, wetted by said ionically conductive liquid, in contact with the imaging surface to minimize contamination of the imaging surface and defining a nip comprising an entrance nip and an exit nip, said entrance nip comprising an initial tangential contact between said contact member and said imaging surface, in the direction of motion of the imaging surface, and having a distance of tangential contact between said contact member and said imaging surface therebetween; and a dispensing member for providing delivery of said ionically conductive liquid to said contact member.

2. An apparatus as recited in claim 1, wherein said contact member minimizes contamination by capturing residual particles at said entrance nip.

3. An apparatus as recited in claim 2, wherein said contact member comprises a translatable contact pad.

4. An apparatus as recited in claim 3, wherein said translatable contact pad comprises a hydrophilic web.

5. An apparatus as recited in claim 4, further comprises a first roll and a second roll, having a common rotational direction, about which said hydrophilic web is wound to advance said hydrophilic web.

6. An apparatus as recited in claim 5, further comprising a center roll, being permeable to said ionically conductive liquid, located between said first roll and said second roll, said center roll being positioned adjacent to the imaging surface such that said hydrophilic web, having two sides, contacts said center roll on one side and the imaging surface on the other side, when a normal force is applied, in creating a contact nip between the center roll and the imaging surface.

7. An apparatus as recited in claim 6, wherein said first roll comprises a supply roll.

8. An apparatus as recited in claim 7, wherein said second roll comprises a take-up roll.

9. An apparatus as recited in claim 8, wherein said hydrophilic web being advanced at a rate of speed determined by an equation of 1000/v, with v being a process speed.

10. An apparatus as recited in claim 6, wherein said dispensing member comprises a porous tube.

11. An apparatus as recited in claim 10, wherein said porous tube, being coupled to said center roll, uniformly distributes said ionically conductive liquid to said center roll for moistening of said hydrophilic web.

12. An apparatus as recited in claim 11, further comprising a conductive member for applying a DC voltage to said ionically conductive liquid.

13. An electrostatographic printing machine including a charging device for applying an electrical charge to an imaging surface having movement, comprising:

an ionically conductive liquid;

a contact member defining a nip comprising an entrance nip and an exit nip, said entrance nip comprising an initial tangential contact between said contact member and said imaging surface, in a direction of motion of the imaging surface, and having a distance of tangential contact between said contact member and said imaging surface therebetween, wetted by said ionically conductive liquid, and in contact with the imaging surface to minimize contamination of the imaging surface by capturing particles at said entrance nip; and a dispensing member for providing delivery of said ionically conductive liquid to said contact member.

14. An electrostatographic printing machine as recited in claim 13, wherein said contact member comprises a contact pad.

15. An electrostatographic printing machine as recited in claim 14, wherein said contact pad comprises a hydrophilic web.

16. An electrostatographic printing machine as recited in claim 15, further comprises a first roll and a second roll, having a common rotational direction, about which said hydrophilic web is wound to advance said hydrophilic web.

17. An electrostatographic printing machine as recited in claim 16, further comprising a center roll, being permeable, located between said first roll and said second roll, said center roll being positioned adjacent to the imaging surface such that said hydrophilic web, having two sides, contacts said center roll on one side and the imaging surface on the other side, when a normal force is applied, in creating a contact nip between the center roll and the imaging surface.

18. An electrostatographic printing machine as recited in claim 17, wherein said first roll comprises a supply roll.

19. An electrostatographic printing machine as recited in claim 18, wherein said second roll comprises a take-up roll.

20. An electrostatographic printing machine as recited in claim 19, wherein said hydrophilic web being advanced at a rate of speed determined by an equation of 1000/v, with v being a process speed.

21. An electrostatographic printing machine as recited in claim 17, wherein said dispensing member comprises a porous tube.

22. An electrostatographic printing machine as recited in claim 21, wherein said porous tube, being coupled to said center roll, uniformly distributes said ionically conductive liquid to said center roll for moistening of said hydrophilic web.

23. An electrostatographic printing machine as recited in claim 22, further comprising a conductive member for applying a DC voltage to said ionically conductive liquid.

* * * * *